US005711458A

United States Patent [19]

Langeveld et al.

[11] Patent Number: 5,711,458

[45] Date of Patent: Jan. 27, 1998

[54] PAINT DISPENSING APPARATUS

[75] Inventors: Michiel Jacobus Johannes Langeveld, Zoetermeer; Johannes Hermanus Nicholaas Post, Sassenheim, both of Netherlands

[73] Assignee: Fluid Management, Inc., Wheeling, Ill.

[21] Appl. No.: 589,732

[22] Filed: Jan. 22, 1996

[51] Int. Cl.[6] ..... B67D 5/60

[52] U.S. Cl. ..... 222/144; 222/144.5; 222/233

[58] Field of Search ..... 222/129, 136, 222/144, 144.5, 233

[56] References Cited

U.S. PATENT DOCUMENTS

| | | | |
|---|---|---|---|
| 3,066,830 | 12/1962 | Heiss et al. | 222/144 X |
| 3,122,272 | 2/1964 | Marsh | 222/144 X |
| 3,321,108 | 5/1967 | Bowe | 222/136 X |
| 4,781,312 | 11/1988 | Strazdins | 222/309 |
| 4,792,236 | 12/1988 | Heinis et al. | 366/245 |
| 4,946,100 | 8/1990 | Flemming et al. | 239/1 |
| 4,967,938 | 11/1990 | Hellenberg | 222/144 |
| 5,078,302 | 1/1992 | Hellenberg | 222/144 |
| 5,119,973 | 6/1992 | Miller et al. | 222/144 |
| 5,474,211 | 12/1995 | Hellenberg | 222/144 X |

FOREIGN PATENT DOCUMENTS

| | | | |
|---|---|---|---|
| 645876 | 7/1962 | Canada | 222/144 |

OTHER PUBLICATIONS 3-inch by 5-inch color photograph of a paint dispensing machine manufactured by Fast Incorported.

"blendorama" advertisement for Model 53P and Model 53PD, Strastint International Limited Partnership, P.O. Box 266, Unanderra NSW 2526, Australia.

"blendorama" advertisement for Model 22P, Strastint International Limited Partnership, P.O. Box 266, Unanderra NSW 2526, Australia.

*Primary Examiner*—Joseph Kaufman

*Attorney, Agent, or Firm*—Fitch, Even, Tabin & Flannery

[57] ABSTRACT

Dispensing apparatus includes canisters mounted on a turntable, the canisters including dispense pumps and valves. Actuators for operating the dispense pumps and valves are located on a service door mounted alongside the turntable. The dispense apparatus is mounted on modular framework to improve serviceability of the components employed.

29 Claims, 12 Drawing Sheets

Fig. 13
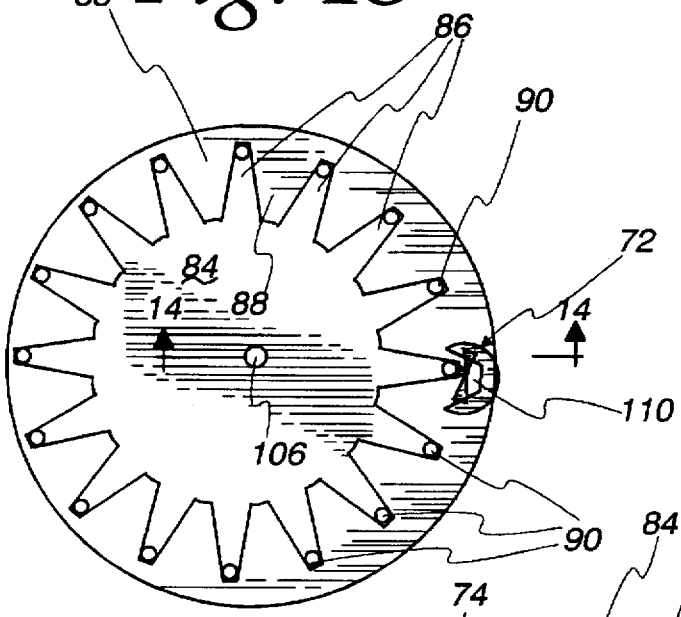
Fig. 14
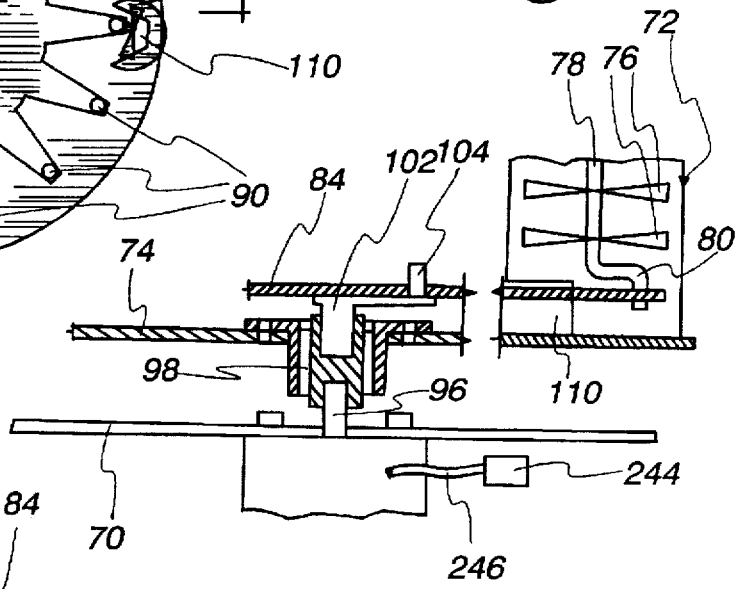
Fig. 16
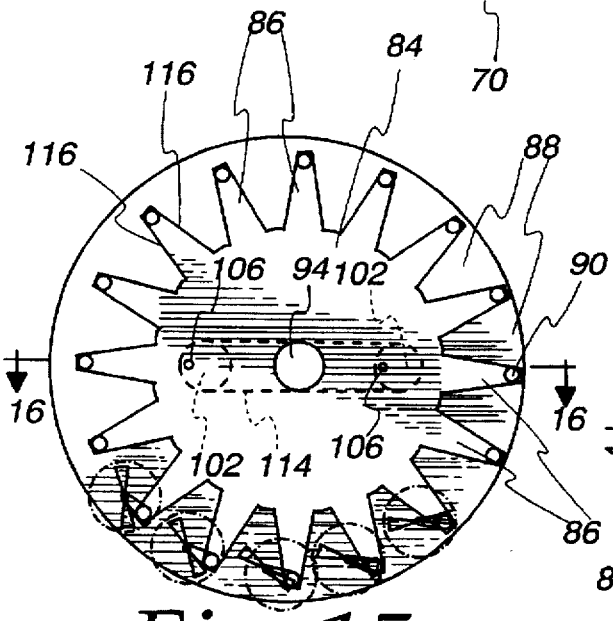
Fig. 15
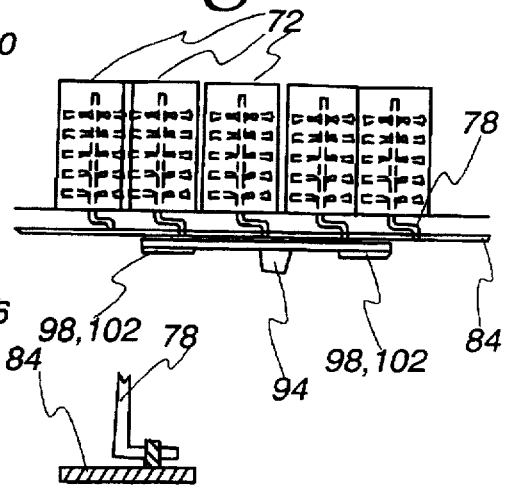
Fig. 16a

PAINT DISPENSING APPARATUS

BACKGROUND OF THE INVENTION

1. Field Of The Invention

The present invention pertains to apparatus for dispensing pulverulent materials such as tinted coating materials, food supplements and perfumes, and more particularly to such apparatus used for making a blended composition using components taken from a plurality of supply canisters.

2. Description Of The Related Art

Automated and semi-automated dispensing apparatus has been employed for some time in a variety of important commercial endeavors, in response to a growing preference in the paint and coatings industry to reduce inventory of premixed blended compositions. Rather, it is preferred that automated or semi-automated dispensing apparatus be relied upon to provide the necessary ingredients according to a predefined formula or recipe. Examples of such apparatus are found in U.S. Pat. Nos. 4,967,938, 5,078,302, 5,193,720, 3,851,798, 5,305,917, 5,361,812, 5,368,196, 5,328,057, 5,407,100 and 5,119,973.

Despite continual improvements in automated dispensing apparatus, further refinements are still being sought. For example, certain materials require periodic cleaning of the dispensing equipment. Advances in reducing the amount of cleaning time, the amount of labor or the level of skill required for such cleaning are still being sought.

In addition, manufacturers of the dispensing equipment are seeking ways of reducing production costs, as well as reducing the time required for producing automatic dispensing products. Reduction in time required to produce automated dispensing apparatus not only results in labor savings, but allows the manufacturer of such equipment to quickly meet customer orders.

One competing consideration which sometimes outweighs a drive for further reductions in fabrication costs is a customer's insistence that equipment be made as compact as possible. For example, it is commonplace in the paint coatings industry to have as many as sixteen similarly sized canisters mounted on a turntable. The canisters contain recipe ingredients to be dispensed according to preselected formulas. Paint coatings and their recipe ingredients oftentimes tend to settle over time and accordingly it has been found necessary to keep the ingredients stored in the canisters in suspension, ready for a subsequent dispensing operation. Because of customer's demands for compact equipment, the storage canister's are oftentimes located close to one another, complicating design and assembly methods required to produce a commercial product having effective canister stirring features. Advances in the art are still being sought which satisfy not only customer's demands for compactness, but also allow a manufacturer of automated dispensing apparatus to enjoy reduced fabrication costs and assembly times.

In order to reduce product costs, automated dispensing apparatus typically employs a common actuator mechanism for operating a plurality of dispensing pumps. In the machines referred to above, the canisters are made to pass across the common actuator, with a desired canister being selected and stopped in position in anticipation of engagement by the actuator mechanism. In order to maintain control over dispensing accuracy, it is important that the actuator mechanism be shielded from unintentional contact which might cause the mechanism to come out of a precise calibration, while at the same time it is important that the actuator mechanism be made available for routine inspection, replacement of worn parts and calibration checks. These operations are particularly important where a user of such automated dispensing apparatus changes the types of materials being dispensed. Those familiar with the paint coatings industry, for example, have noted the increased rate of changes of coating formulations. A potential need arises, for each change in paint coating formulations, and particularly with changes in paint coating materials, that access to the actuator mechanism be readily gained, to perform all necessary calibration checks and adjustments.

SUMMARY OF THE INVENTION

It is an object of the present invention to provide automated dispensing apparatus having a common actuator for dispensing materials from a plurality of storage canisters.

Another object of the present invention is to provide such apparatus with a dispensing actuator which is readily accessible for service operations, and which can be readily withdrawn from the storage canisters to allow better access for cleaning storage canisters, and to prevent unintentional contamination of the actuator mechanism.

A further object of the present invention is to provide apparatus of the above-described type in which the dispensing actuator mechanism is mounted on a service door so as to allow ready access to the dispense actuator mechanism, and to facilitate removal of the mechanism, if necessary. Such construction, if properly employed, could also result in cost savings for manufacturers of automated dispensing apparatus, allowing the manufacturers to fabricate the actuator mechanism as a separate sub-assembly on a bench top environment.

A further object of the present invention is to provide an improved framework for mounting the service door carrying the dispense actuator mechanism, consistent with increasing customer demands for greater dispense accuracies.

Yet another object of the present invention is to provide automated dispense apparatus having a plurality of storage canisters carried on a common turntable, the turntable being rotated to present a desired canister to a dispensing station.

A further object of the present invention is to provide such apparatus having improved canister positioning, insuring desired alignment of a selected canister at the dispensing station.

Another object of the present invention is to provide such automated dispensing apparatus having means for supporting the turntable against distorting forces experienced during a dispense operation. For example, when dispensing of larger quantities of materials is required, use of larger dispensing pumps can be expected. Such pumps require increased support for the canisters and their associated turntable because of the greater mechanical forces associated with larger pump size. Also, in the paint coatings industry, for example, there is a trend to concentrate the materials to be dispensed in a given recipe. One result of such trend, is that the dispensing materials are becoming increasingly difficult to pump, typically requiring greater pump force to complete a dispensing operation. A turntable, which can otherwise be constructed of light weight material so as to attain weight and cost savings, may have to be reinforced or made more massive to successfully withstand the greater pump forces experienced in the dispensing apparatus.

It is an object of the present invention to provide a cost effective strengthening reinforcement for the turntable, without requiring complicated structures or increasing the mass of the turntable.

These and other objects according to the principles of the present invention are provided in dispensing apparatus for dispensing a plurality of pulverulent materials, comprising:

a plurality of canisters for storing materials to be dispensed;

a dispensing station whereat the materials are dispensed;

a plurality of metering pumps, associated with respective ones of said plurality of canisters for receiving materials therefrom, the metering pumps including pump operators for dispensing preselected amount of materials withdrawn from the canisters;

a movable platform for supporting the plurality of canisters and for presenting preselected ones of the plurality of canisters to the dispensing station;

a frame supporting the platform;

a door at the dispensing station, hingedly supported by the frame;

pump actuator means carried on the door, for engaging the pump operators and for actuating the pump operators to selectively withdraw and dispense preselected amounts of materials from the canisters.

Other advantages of the present invention are attained in apparatus for dispensing flowable materials, comprising:

a plurality of canisters for holding the flowable materials, a plurality of metering pumps for withdrawing preselected quantities of materials from the canisters and for discharging the materials, and a plurality of valves associated with the metering pumps, for controlling the flow of materials discharged from the metering pumps;

a workstation adjacent the metering pumps and valves, where materials are dispensed;

turntable means for moving the metering pumps and valves so as to present a preselected metering pump and valve to the workstation;

a first housing at least partly surrounding the metering pumps and valves and defining a doorway opening, a second housing defining an enclosed cavity and supporting the first housing from below;

a door frame joined to the first housing so as to surround the doorway opening, the door frame extending above the first housing;

a service door hingedly mounted to the door frame so as to swing between closed and open positions, toward and away from the canisters;

a metering pump actuator carried on the service door, including pump engaging means and means for moving the pump engaging means between first and second pump actuator positions;

a valve actuator carried on the service door, including valve engaging means and means for moving the valve engaging means between first and second valve actuator positions.

Further objects of the present invention are attained in apparatus for dispensing flowable materials, comprising:

a plurality of canisters for holding the flowable materials, a plurality of metering pumps for withdrawing preselected quantities of materials from the canisters and for discharging the materials, and a plurality of valves associated with the metering pumps, for controlling the flow of materials discharged from the metering pumps;

a workstation adjacent the metering pumps and valves, where materials are dispensed;

a housing at least partly surrounding the metering pumps and valves, turntable means for carrying the metering pumps and valves so as to present a preselected metering pump and valve to the workstation, at least a portion of the turntable being made of magnetic material; drive means for moving the turntable to bring a selected canister to the workstation;

braking means adjacent the turntable to stop movement of the turntable to align the selected canister at the workstation, the braking means comprising an electromagnet supported by the housing adjacent the turntable to magnetically attract the turntable so as to engage the turntable.

BRIEF DESCRIPTION OF THE DRAWINGS

FIG. 13 is a top plan view of the turntable portion thereof;

FIG. 14 is a cross-sectional view taken along the line 14—14 of FIG. 13;

FIG. 15 is a top plan view of an alternative turntable arrangement;

FIG. 16 is a cross-sectional view taken along the line 16—16 of FIG. 15;

Figure 18:
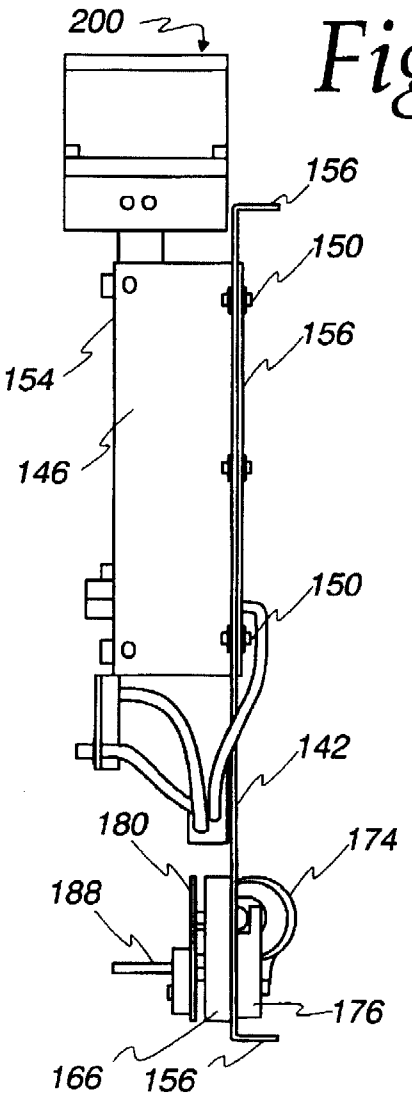
Figure 17:
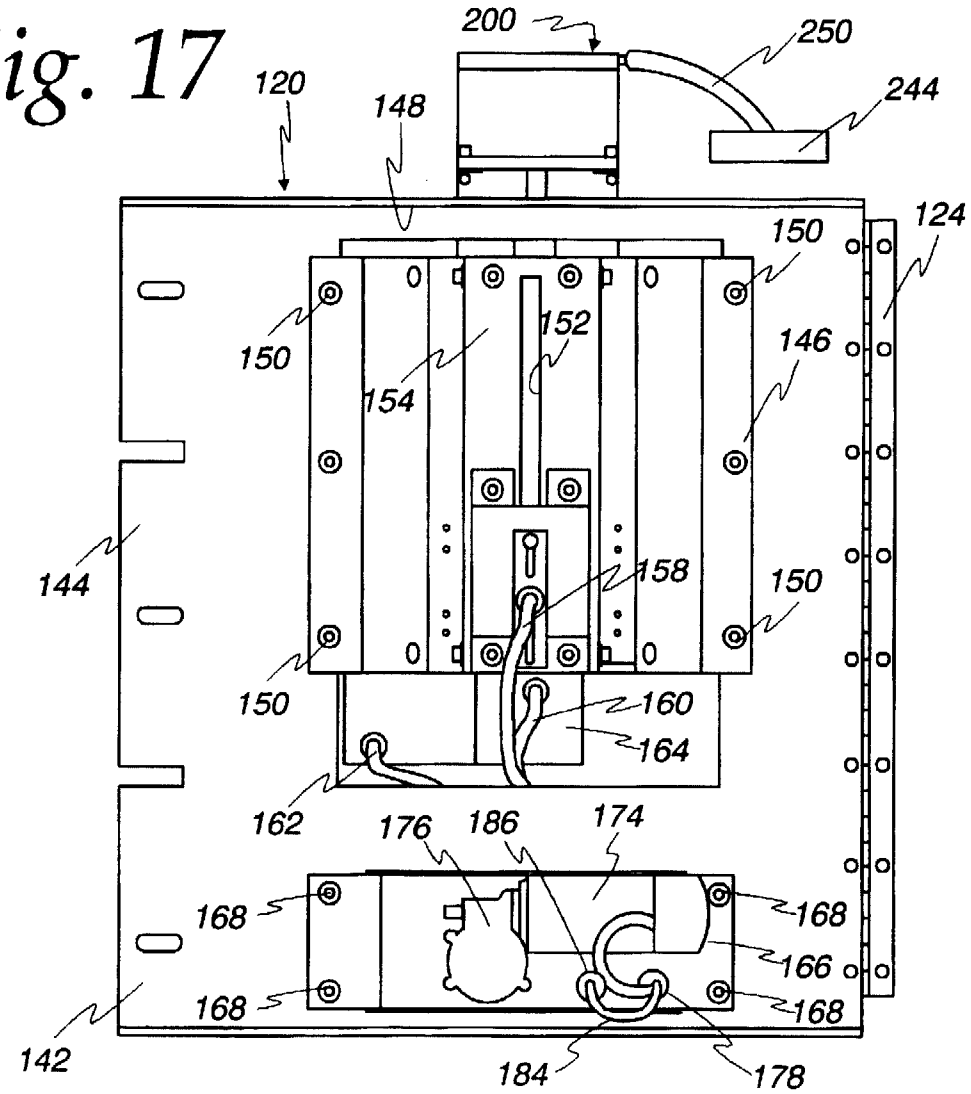
Figure 19:
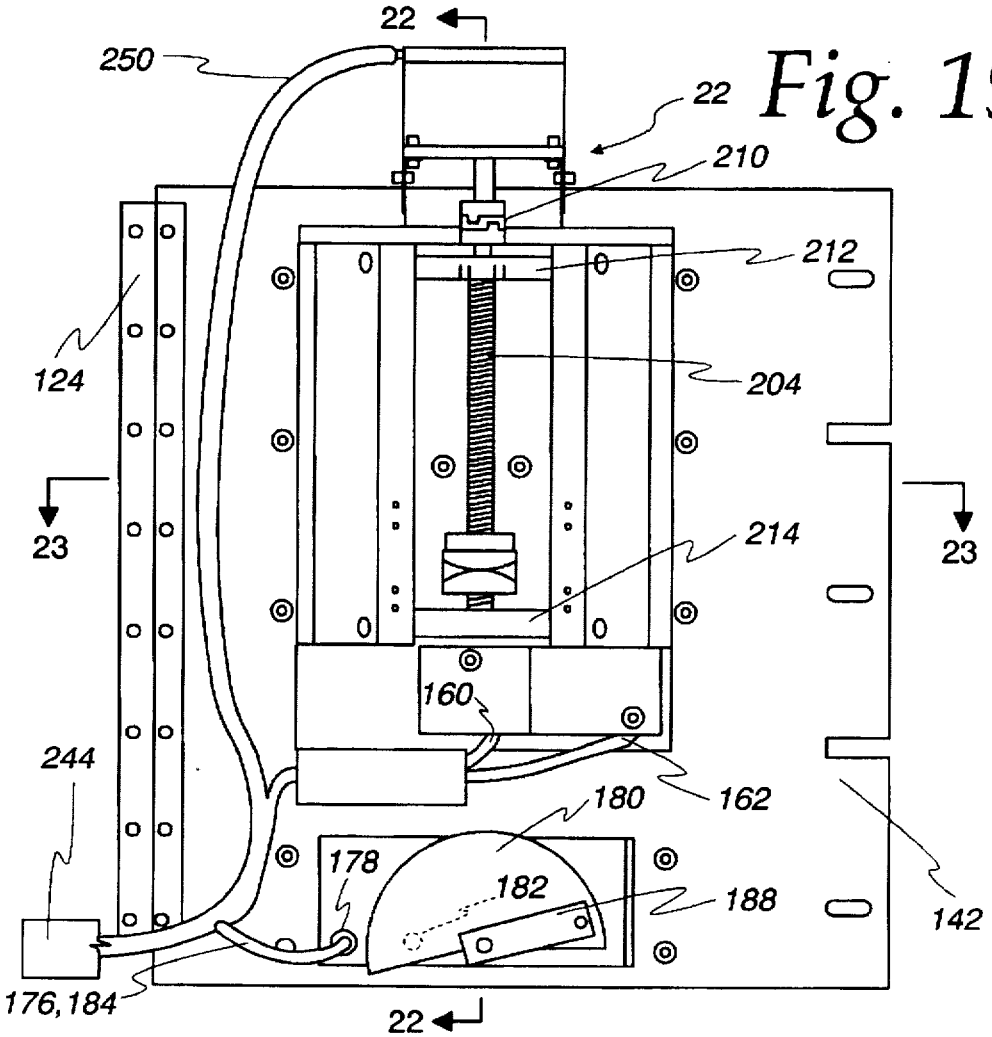
Figure 20:
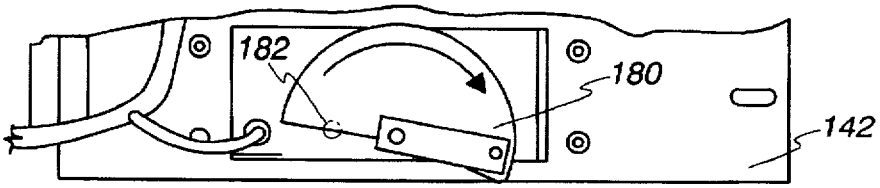
Figure 21:
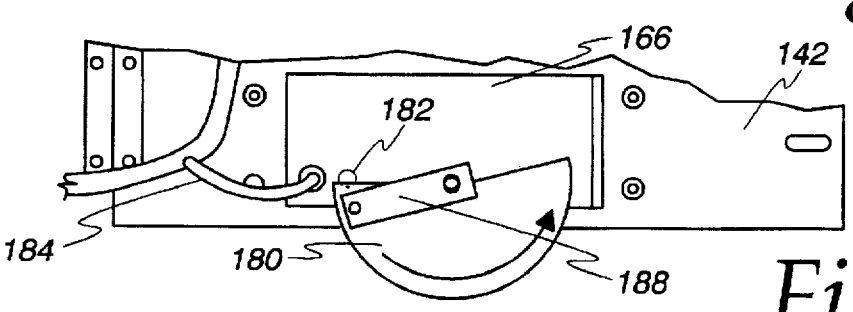
Figure 22:
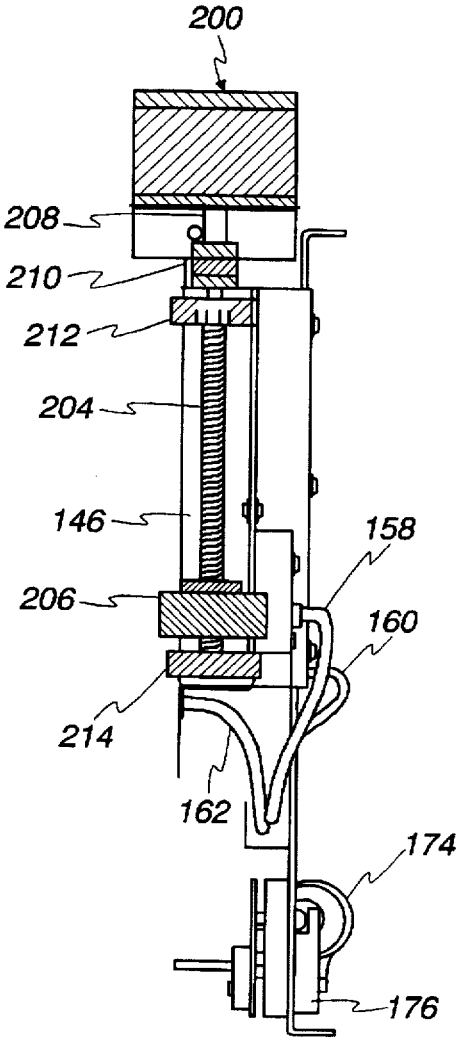
Figure 26:
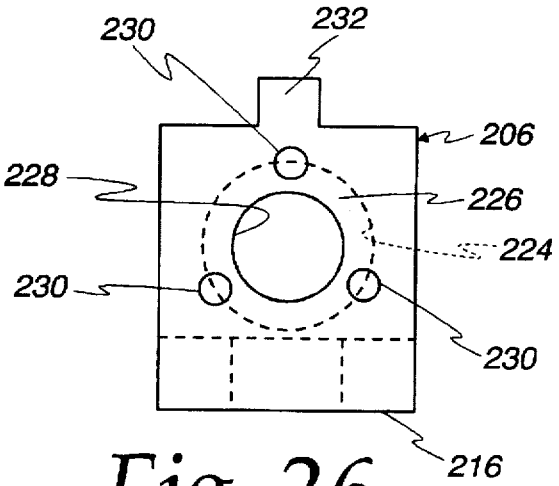
Figure 24:
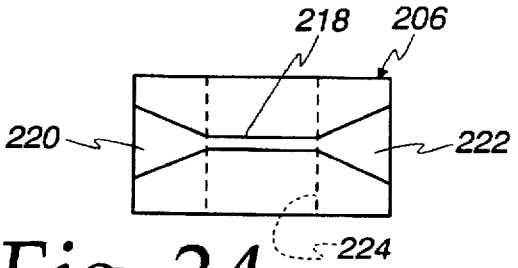
Figure 25:
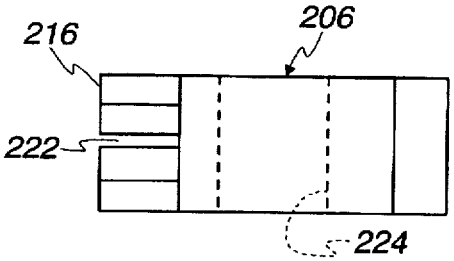
Figure 23:
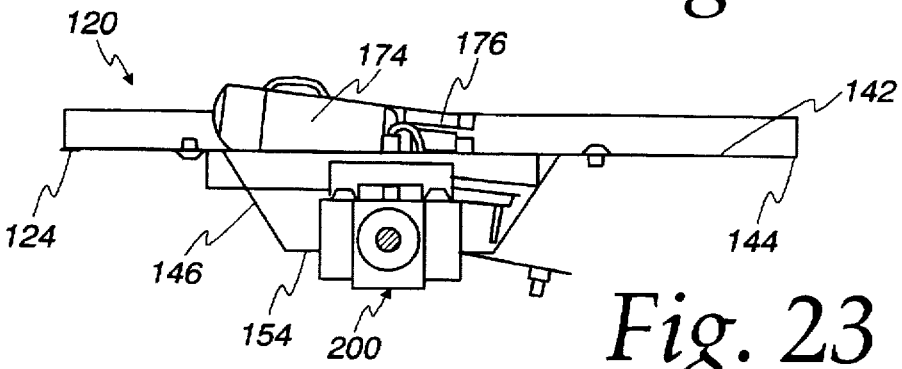
Figure 30:
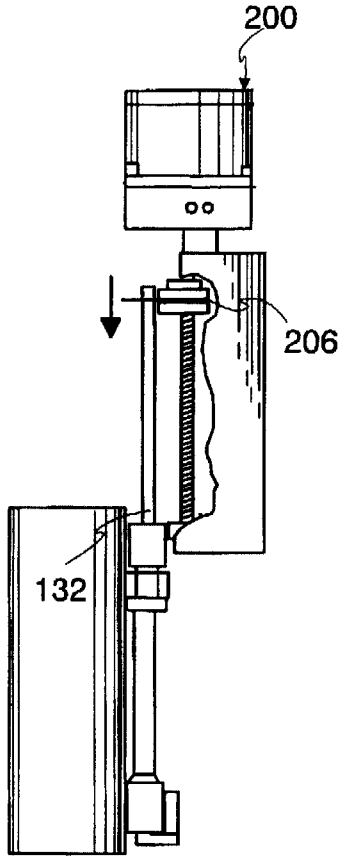
Figure 29:
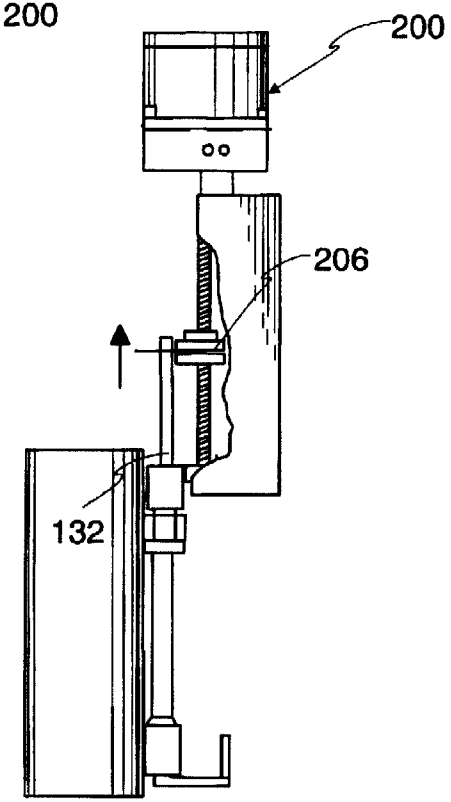
Figure 28:
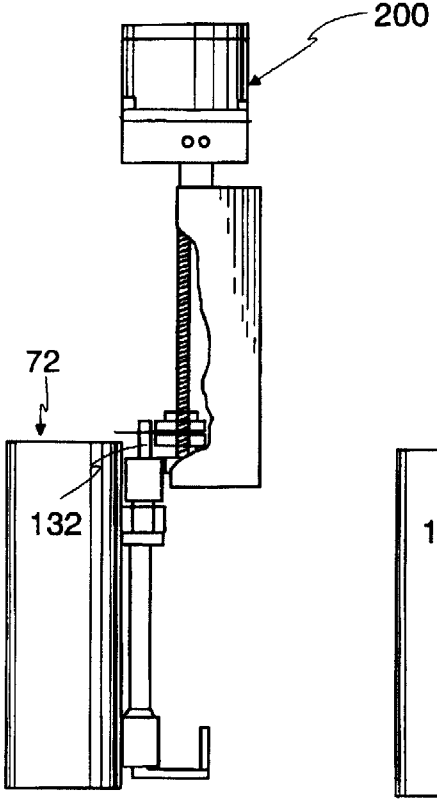
Figure 27:
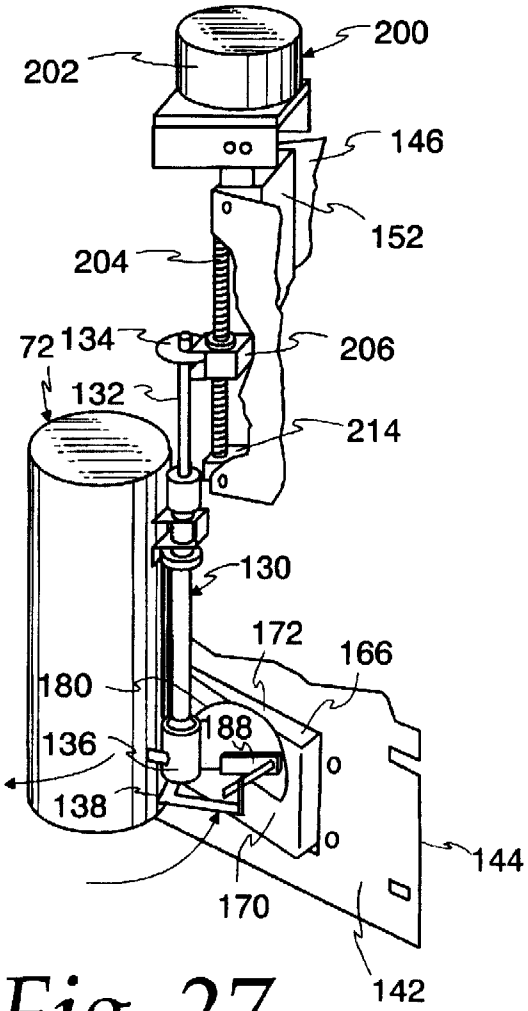

FIG. **16*a* is a fragmentary cross-sectional view showing an alternative arrangement for connecting the crank rods and drive plate shown in FIG. 16**;

FIG. 17 is a front elevational view of the service door portion of the dispensing apparatus;

FIG. 18 is a side elevational view thereof;

FIG. 19 is a rear elevational view thereof;

FIGS. 20 and 21 are fragmentary portions of FIG. 19 showing a sequence of operation;

FIG. 22 is a cross-sectional view taken along the line 22—22 of FIG. 19;

FIG. 23 is a cross-sectional view taken along the line 23—23 of FIG. 19;

FIG. 24 is a front elevational view of the guide block shown in FIG. 22;

FIG. 25 is a side elevational view thereof;

FIG. 26 is a top plan view thereof;

FIG. 27 is a fragmentary perspective view of the service door, shown partly broken away; and FIGS. 28–30 are fragmentary side elevational views of the service door showing a sequence of operation.

DETAILED DESCRIPTION OF THE PREFERRED EMBODIMENTS

Figure 1:
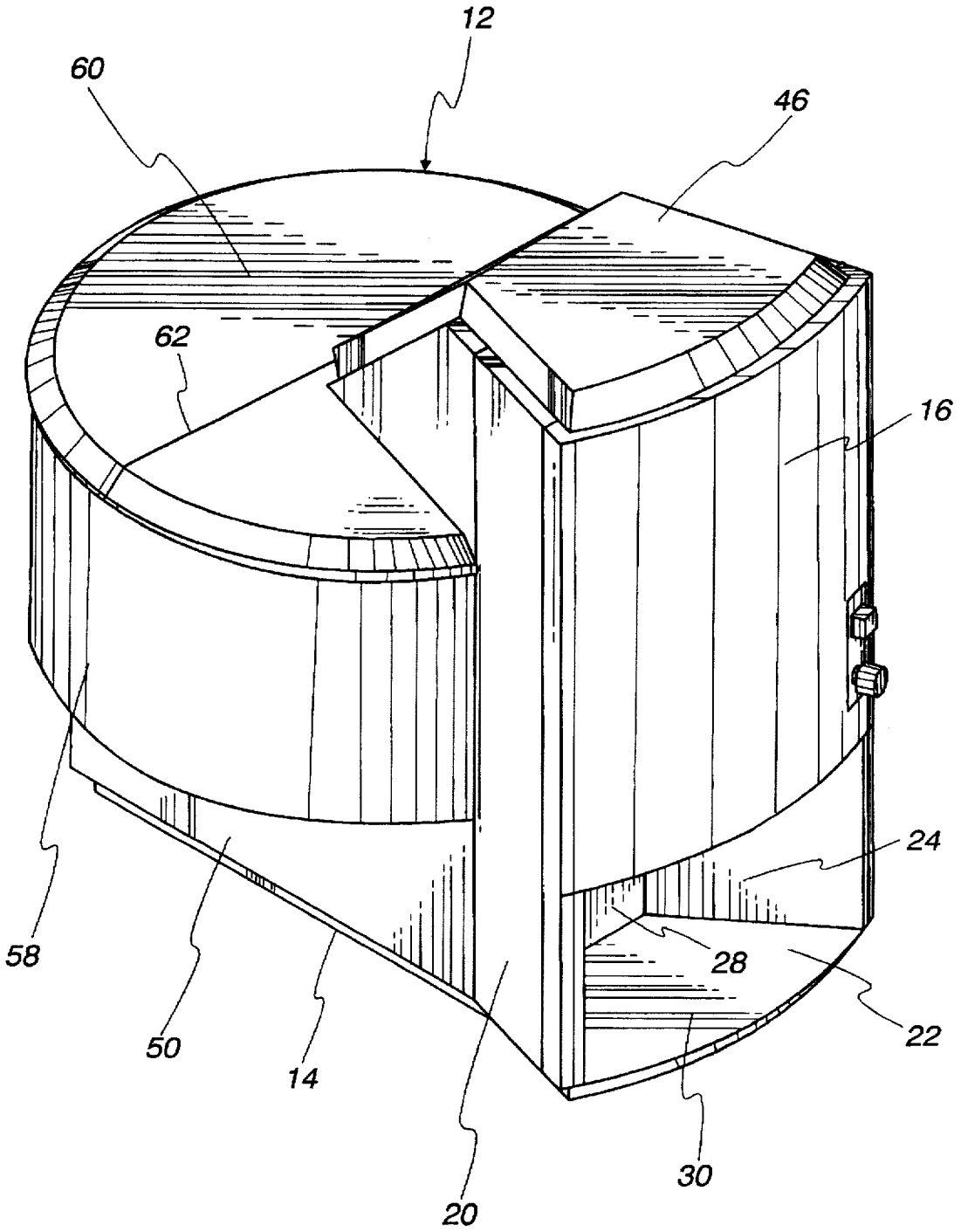
FIG. 1 is a perspective view of paint dispensing apparatus according to principles of the present invention.
Figure 2:
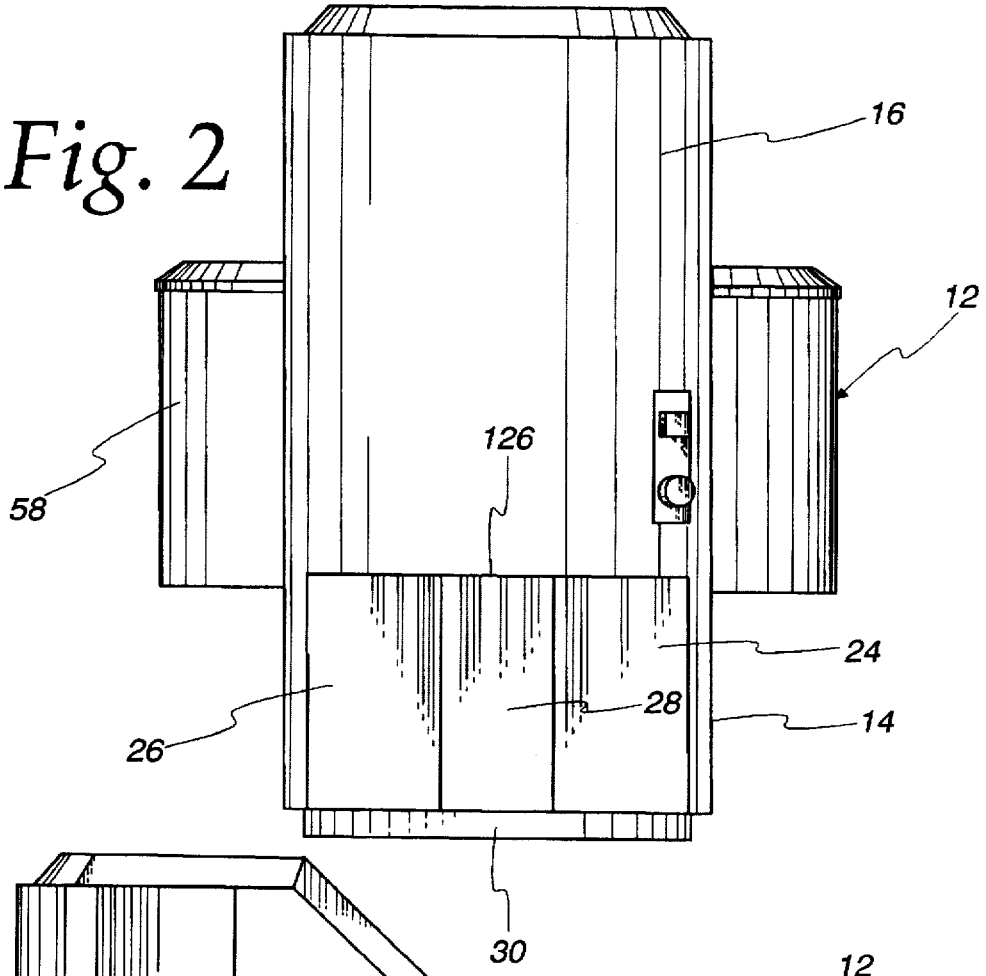
FIG. 2 is a front elevational view thereof.
Figure 3:
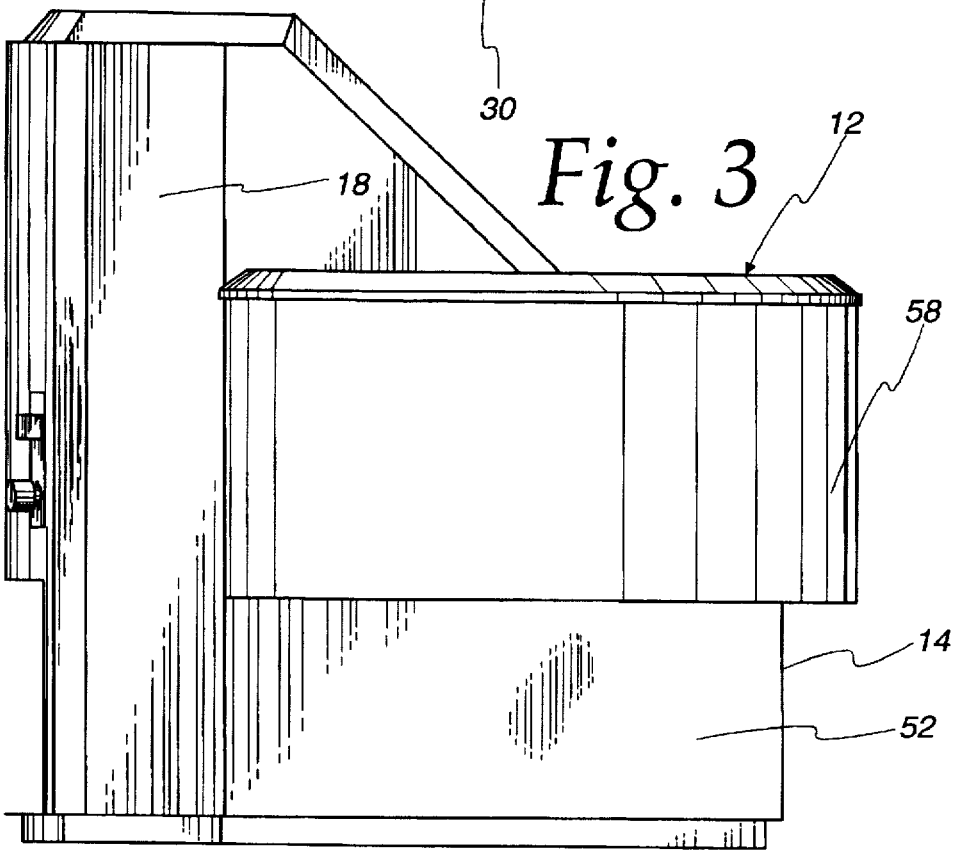
FIG. 3 is an elevational view of the right side thereof.
Figure 4:
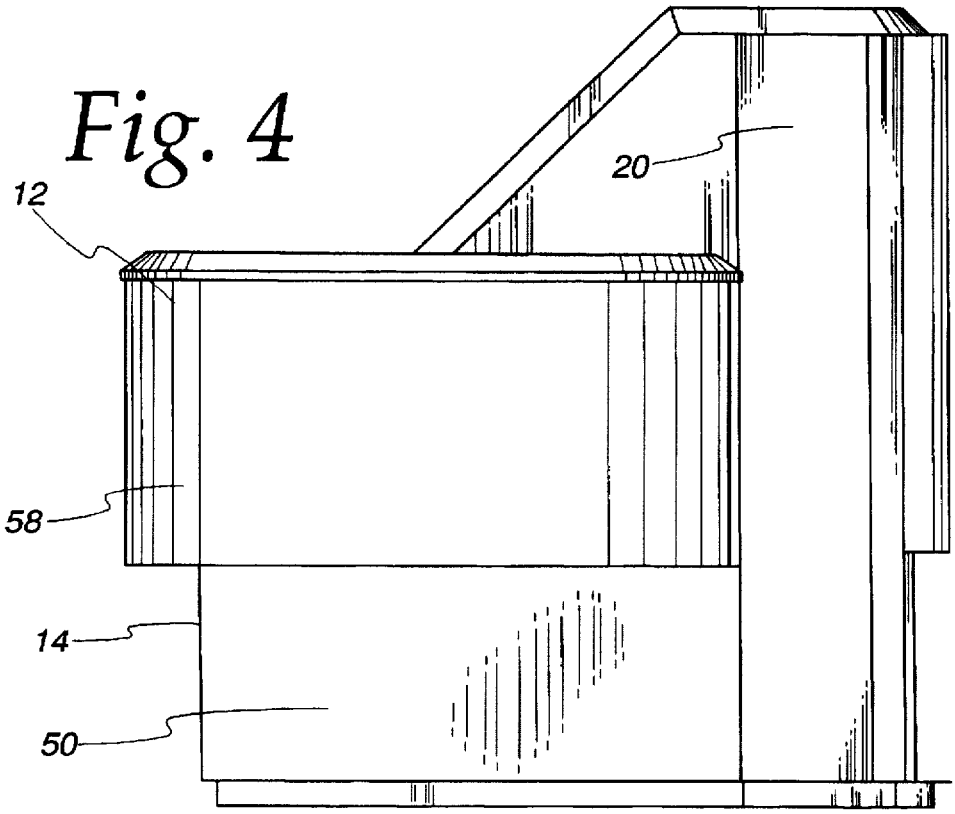
FIG. 4 is an elevational view of the left side thereof.
Figure 5:
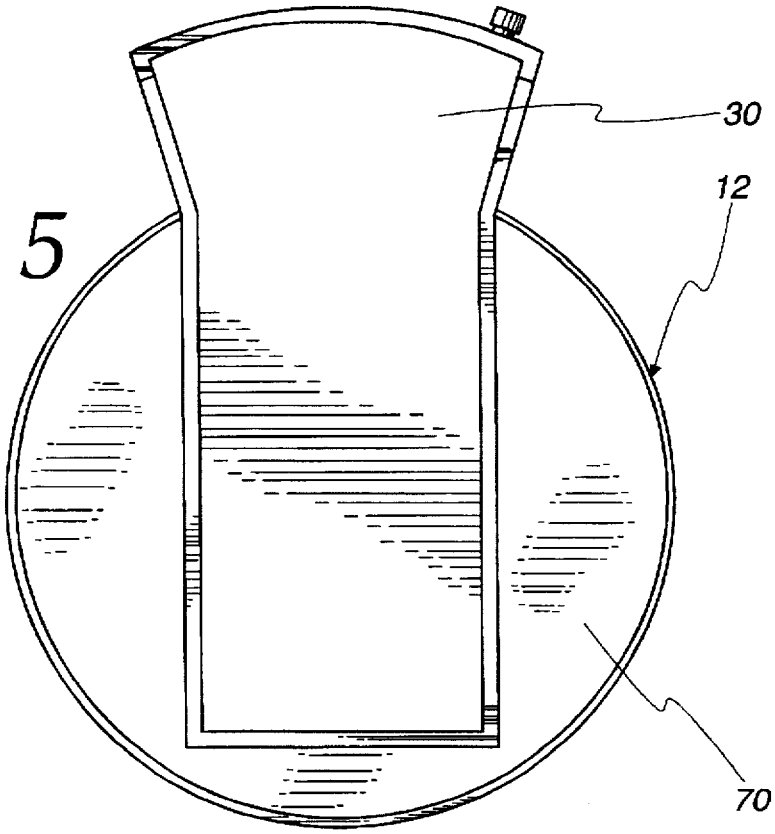
FIG. 5 is a bottom elevational view thereof.
Figure 6:
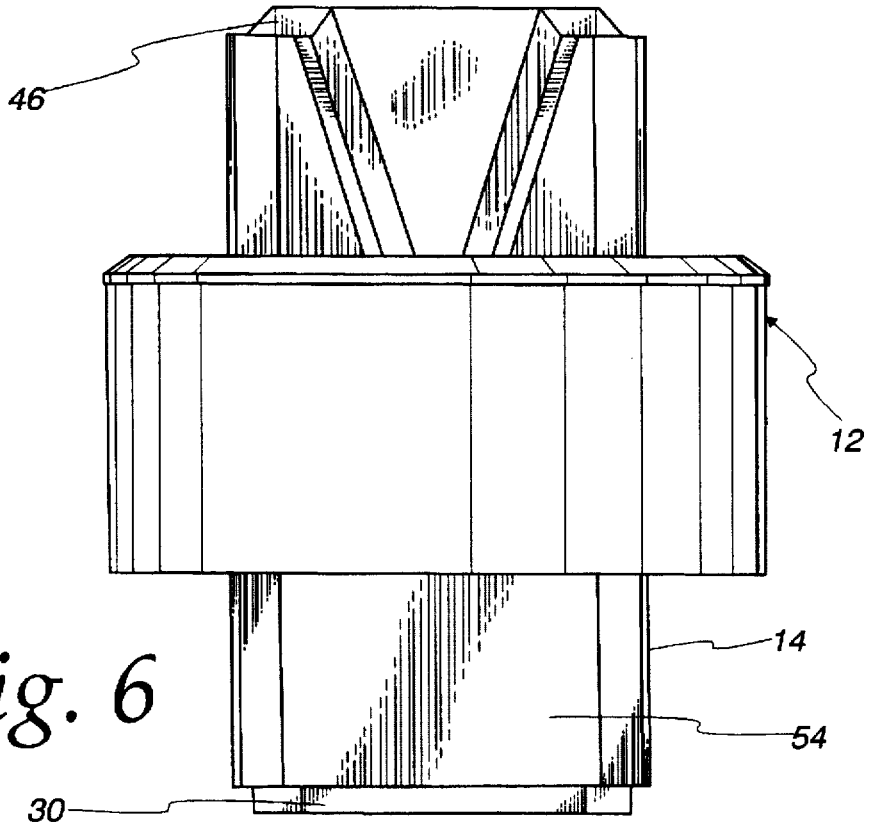
FIG. 6 is a rear elevational view thereof.
Figure 7:
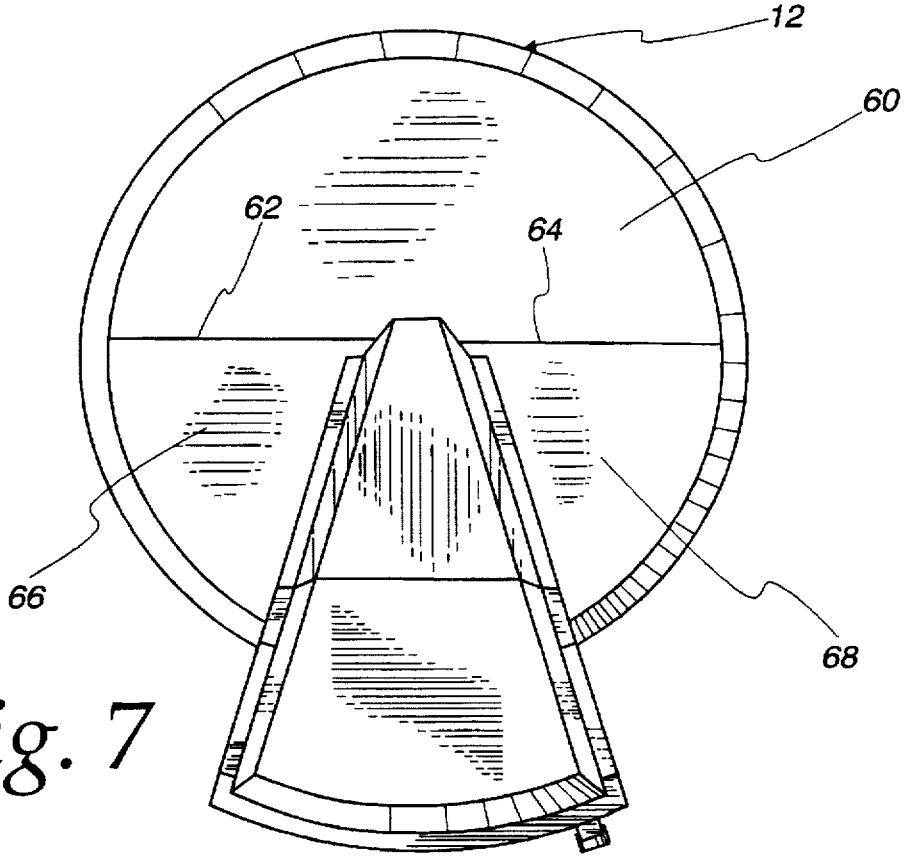
FIG. 7 is a top plan view thereof.

Referring initially to FIGS. 1–7, paint dispensing apparatus according to principles of the present invention is generally indicated at 10. Apparatus 10 includes a generally cylindrical canister housing 12 mounted on a base 14. A door 16 is hinged at its right-hand side to a door frame member 18 (see FIG. 3). An opposing door frame member 20 (see FIG. 4) cooperates with door 16 to seal mechanism behind the door, as will be seen herein. Referring to FIGS. 1 and 2, the container-receiving cavity 22 is formed by sidewalls 24, 26, a rear wall 28 and a floor 30. Preferably, the sidewalls 24, 26 are supported by door frame members 18, 20, while floor 30 extends beneath base 14 as can be seen, for example, in FIG. 8.

Figure 8:
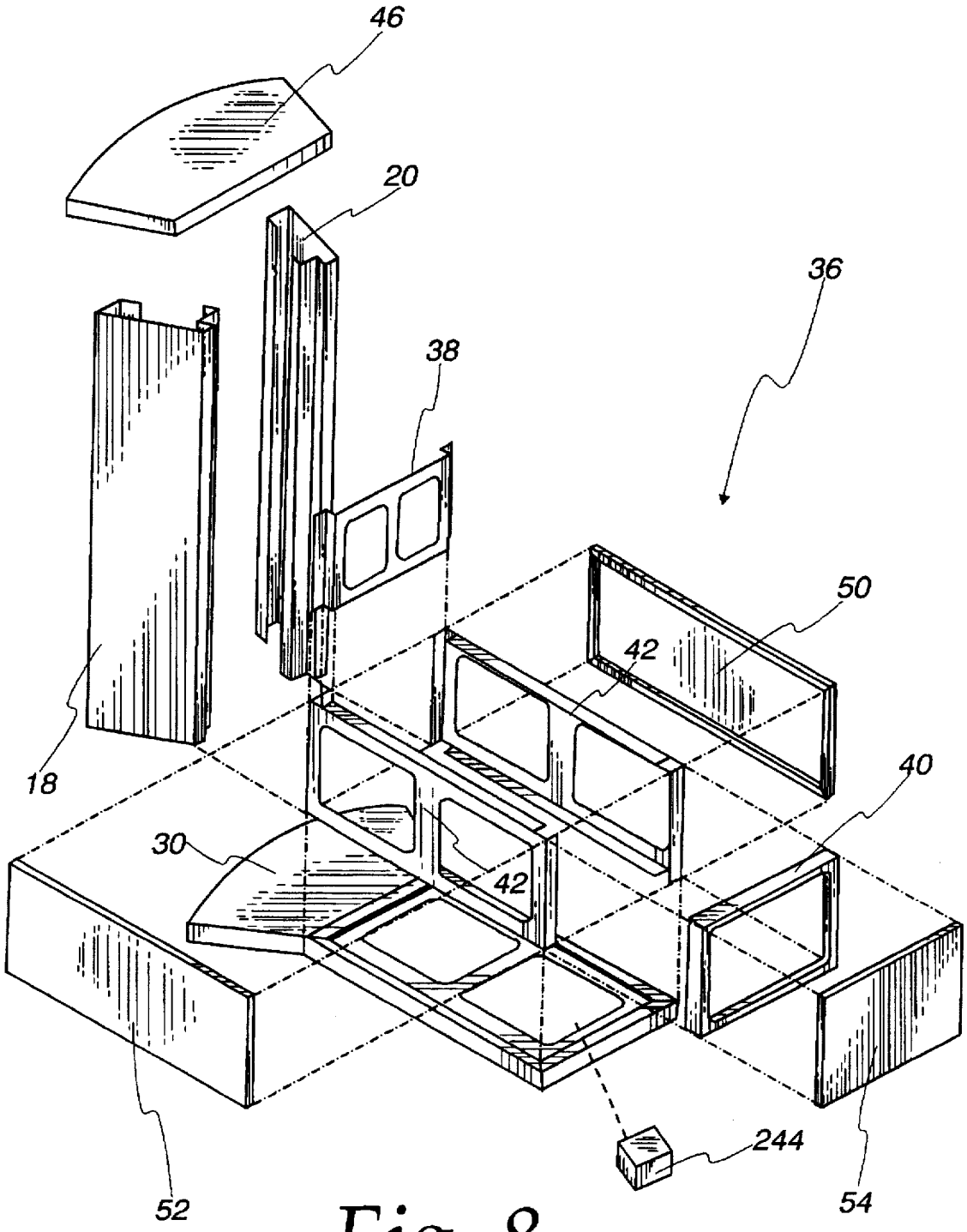
FIG. 8 is an exploded perspective view of the framework portion thereof.

Referring now to FIG. 8, supporting framework construction is generally indicated by 36. In addition to the aforementioned floor 30, framework construction 36 includes front and rear internal walls 38, 40, internal side walls 42 and upright pillars comprising the door frame members 18, 20. Several exterior panels complete the support construction. For example, top wall 46 is mounted atop door frame members 18, 20 and is preferably permanently secured thereto. Taken together members 46, 18 and 20 comprise a door frame assembly which surrounds the opening in canister housing 58. Further, side wall panels 50, 52 are removably secured to their underlying internal wall members, by conventional fasteners. As can be seen in FIG. 8, the internal supporting walls 48-42 have relatively large openings, affording ready access to equipment located within the cabinet work.

Referring to FIG. 1, the canister housing 12 includes a generally cylindrical side wall 58, a cover 60 which (referring additionally to FIG. 7) is hinged at 62 and 64 for opening of access doors 66, 68 so as to gain access for filling canisters located within housing 12. If desired, the doors 66, 68 could be combined into a single door.

Figure 9:
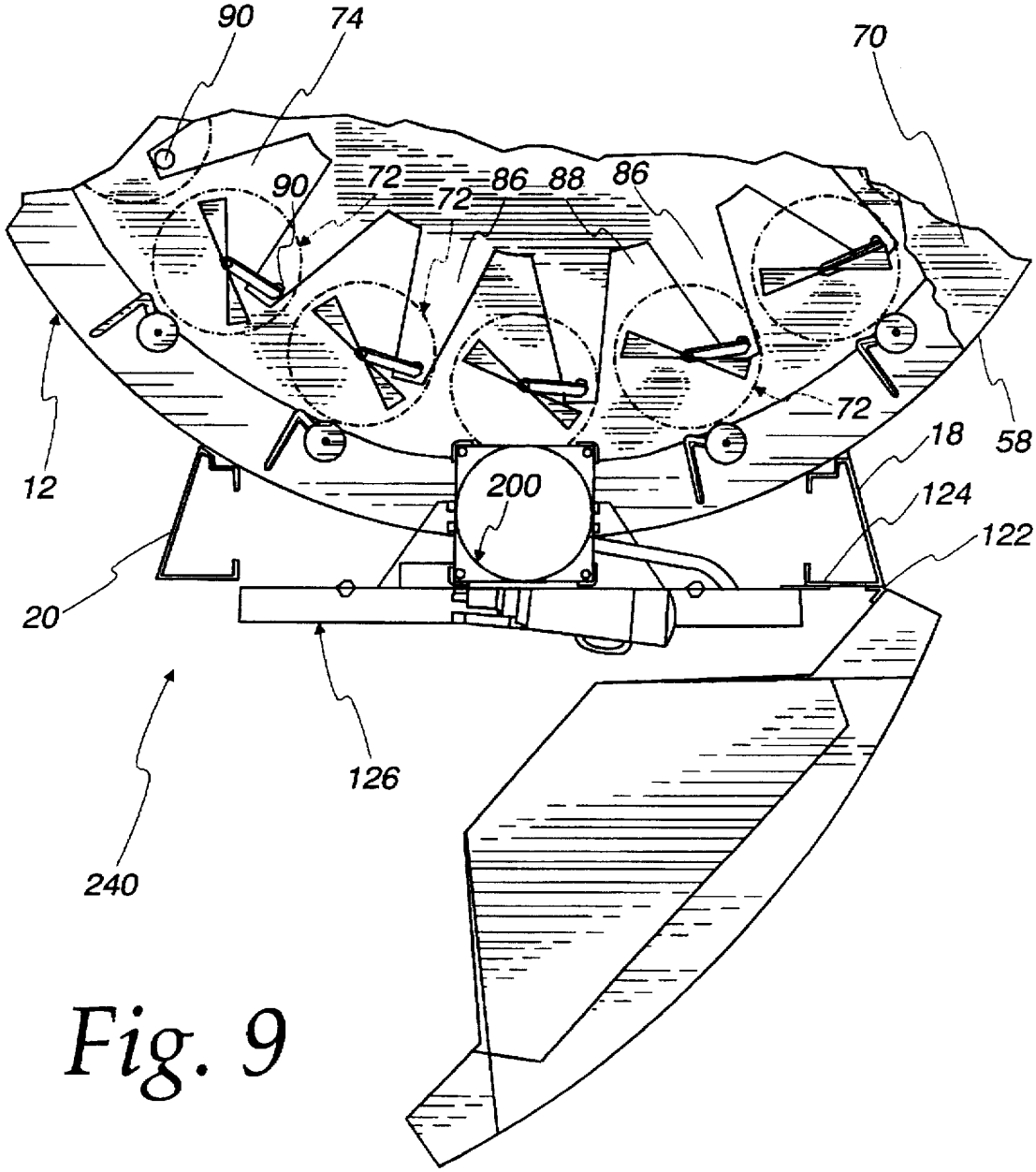
FIG. 9 is a fragmentary top plan view thereof, shown partly broken away, and with the outer cover removed.

Referring now to FIG. 9, a fragmentary cut-away view of apparatus 10 is shown. Canister housing 12 includes a floor 70 (which can also be seen in the bottom plan view of FIG. 5). A plurality of canister assemblies 22 are mounted on a platform or turntable 74. Referring to FIG. 14, the canister assembly 72 include a plurality of stirring blades 76 mounted on a common stirring rod 78 having a crane-like structure at its bottom end 80. In the preferred embodiment, canister assemblies 72 preferably comprise commercially available canister and plunger assemblies Model Nos. 7187, 7188, 3816, 3817 and 3836 for the manual dispensers offered for sale by the assignee of the present invention under the model designation "Blendorama" Canister assemblies described in commonly assigned U.S. Pat. No. 4,781, 312 (the disclosure of which is herein incorporated by reference) could also be used.

Referring again to FIG. 9 and FIG. 14, apparatus 10 includes a stirrer drive plate 84 which is generally star-shaped, having a plurality of outwardly radiating fingers 86 defining a plurality of gaps 88 between the fingers. As can be seen in FIG. 14, bottom ends 80 of steel rods 78 are received in the apertures 90 of stir drive plate 84. If desired the plate 84 could be solid and uninterrupted, i.e., a circular disk without fingers.

Referring again to FIG. 14, a conventional bi-directional electric drive motor 94 having an output shaft 96, is mounted to bottom wall 70. A conventional one-directional coupling (or bearing) 98 couples motor outward shaft 96 to turntable 74 and to a crank arm 102 having a spindle 104 received in an aperture 106 (see FIG. 13) forming the central portion of stir drive plate 84.

As can be seen in FIG. 13, aperture 106 is formed slightly off center of plate 84. Accordingly, as crank arm 102 is rotated about the axis of motor outward shaft 96, plate 84 is made to sweep an eccentric orbit. As a consequence, the apertures 90 formed in the fingers 86 of plate 84 are also made to sweep respective eccentric orbits causing stir rod 78 to rotate about their longitudinal axes, thus driving stir blades 76 within the canisters.

As mentioned, coupling 98 is a conventional one-directional coupling which provides drive power to both turntable 74 and crank 102 only when motor 94 is energized so as to rotate in a first direction. As motor 94 is energized to rotate in an opposite direction, drive power is applied to crank 102. To rotate the table for stirring, turntable 74 is disconnected by the function of coupling 98. As indicated in FIG. 14, a window 110 is formed in the bottom of the canister so as to allow the entry of finger 86 of drive plate 82 so as to engage the bottom end 80 of stir rod 78. The cross-sectional view of FIG. 14 shows the bottom end of the canister resting on the turntable 74 while allowing engagement of the drive plate and stir rod.

Figure 10:
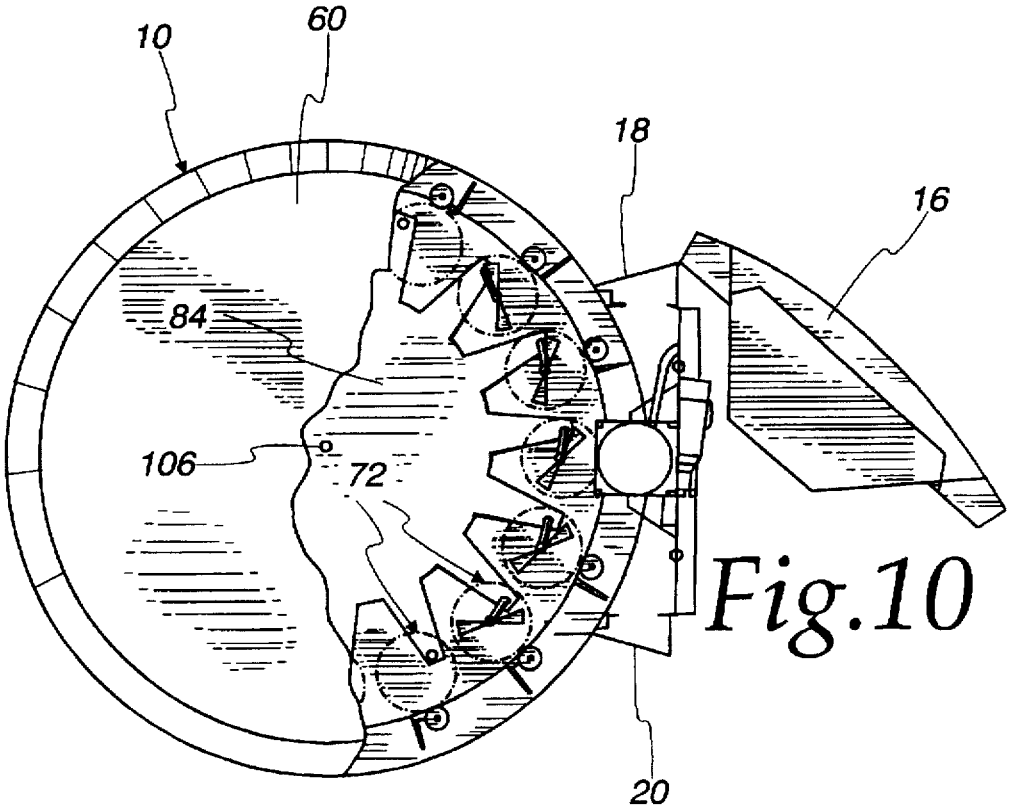
FIG. 10 is a top plan view thereof shown partly broken away.

Referring to FIG. 10, it can be seen that the canister assemblies 72 are spaced relatively close together, making it difficult to drop the canister assemblies into position during assembly of the dispensing apparatus. In order to alleviate these problems of assembly, an alternative embodiment of the dispenser apparatus is provided, as shown in FIGS. 15 and 16. The arrangement shown in FIGS. 15 and 16 differs from that already described, only with reference to the stir drive mechanism. Referring now to FIG. 15, the same stir drive plate 84 is employed, but is modified, in that a pair of holes 106 are formed in the plate interior. In the embodiment shown in FIGS. 15 and 16, the motor 94 drives a timing belt 114 which in turn drives a pair of cranks 102. The timing belt maintains the cranks in synchronism, but still the drive plate 84 is made to sweep an eccentric orbit with the alternative arrangement. An advantage, however, is that the stir rod 78 need no longer be located in apertures 90 formed in fingers 86. Rather, pins are inserted in the apertures 90 so as to extend upwardly above fingers 86. The crank rods 78 are modified to have lower free ends which are horizontally extending (see FIG. 16*a*). The lower ends 80 of stir rods 78 are located in the gaps 88 formed between fingers 86. The pins in fingers 86 engage the lower ends 80 of stir rods 78, again causing the stir rods to rotate about their central axes, driving stir blades 76 within the canisters. Ease of assembly of automated dispensing apparatus 10 is significantly improved in that the stirring rods of the canister assemblies need not be accurately positioned at the time of insertion so as to insure passage of the lower stir rod ends 80 within stir drive plate apertures 90.

Referring again to FIG. 9, automated dispensing apparatus 10 includes a service door assembly generally indicated at 120, located interiorly of outer door 16. In the preferred embodiment, both outer door 16 and interior service door assembly 120 are hinged to door frame 18 by separate, but closely spaced hinges 122, 124, respectively. As will now be appreciated that the service door assembly 120 is shielded from outside contamination, including any spillage that might occur in the container-receiving cavity 22. If desired, doors 16, 120 could be combined to form a single, common assembly.

Referring briefly to FIGS. 27–30, the canister assemblies 72 include a single action piston pump assembly generally indicated 130 and including a piston pump shaft 132 which is movable within the pump in the manner indicated in FIGS. 28–30. In place of a manually graspable handle provided in the conventional pump assemblies, a washer 134 is mounted above the pump shaft 132. A valve mechanism 136 is located beneath the piston pump, and includes an inlet connection to the interior of the storage canister, while the outlet of the valve allows dispensed material to be discharged in a downward direction, into the container receiving cavity 22. When employed for dispensing paint coating ingredients, an open top container of paint base material is typically located in container receiving cavity 22, in order to receive ingredients dispensed from selected canister assemblies positioned above the container-receiving cavity.

As mentioned, the canister assembly 72, dispenser pumps and valves 136 are all of conventional construction. The valves 136 are preferably operated in two positions, the first being a closed position, but with the pump chamber opened to the canister interior allowing materials to be withdrawn from the interior of the canister, into the pump chamber, with the height of the pump shaft 132 controlling the amount of materials withdrawn into the dispense pump. The valve 136 is then moved to the second operating position to open the pump chamber to an outlet port located at the bottom of the valve, and to close off communication between the pump interior and the canister interior.

In operation of the canister assembly, the pump shaft 132 is first raised and lowered while an operating handle 138 located on the bottom of valve assembly 136 is moved (with reference to viewing the pump assembly from the front) left to right and back again in a generally horizontal plane. As will be seen herein, separate automated actuator systems are employed to operate the pump and valve components of canister assemblies 72. In order to provide a common frame of reference for actuator movement and to alleviate problems arising from three-dimensional alignment of the actuator systems, both actuator systems are mounted in a common service door assembly.

Referring now to FIGS. 17–23, the service door assembly 120 includes a door plate 142 which (from a point of view taken outside of the dispensing apparatus) is hinged at the right-hand side, by hinge 124, as shown in FIG. 17. As mentioned, hinge 124 is secured to door frame 118. The opposing side edge 144 of door panel 142 is removably secured to door frame 120 with removable fasteners, such as turn bolts or screws. A mounting plate 146 having the first portion of generally—trapezoidal cross-section, is received in a central aperture 148 in plate 142. Sides of mounted plate 146 are secured to plate 142 by screw fasteners 150, as can be seen in FIG. 17. As can be seen in FIG. 17, a vertically elongated slot 152 is formed in central wall portion 154 of mounting plate 146.

Referring now to the side elevational view of FIG. 18 (taken from the left-hand side of FIG. 17) plate 146 includes an outwardly turned lip 156 at its upward end. The service door assembly 120 includes a plurality of sensors for sensing the position of various components associated with a dispensing operation. For example, a sensor having an electrical lead 158 is mounted in the bottom central portion of mounting plate 146. Preferably, the sensor is inserted through an aperture formed in the service door, so as to have its active service end looking toward the interior of the canister housing. Similarly, sensors having electrical leads 160, 162 are mounted just below the mounting panel 146. Preferably, they are inserted in an auxiliary mounting panel 146 which is suspended from the central portion 154 of mounting plate 146. The sensors having electrical leads 160, 162 are also "forward looking", that is, have their active service ends looking toward the interior of the canister housing. The sensors preferably comprise induction sensors, but other conventional sensors, such as photosensors or magnetic switching sensors, could also be employed.

As can be seen at the bottom of FIG. 17, a lower auxiliary mounting plate 166 is secured by screw fastener plate 142. As can be seen, for example, in FIG. 27, the lower auxiliary mounting plate 166 is not planar, but rather has a major body portion 170 received in an aperture 172 in plate 142 so as to be disposed at an acute angle to the plane of plate 142. A valve actuating motor 174 has an electrical lead 176 which passes through a grommet 178 received in mounting plate 166. The valve actuator motor 174 drives a gear box 176 having an output shaft on which a timing plate 180 is mounted (see FIG. 27, for example).

A sensor 182 has an electrical lead 184. The sensor is mounted in a manner similar to that indicated above, being inserted in a grommet 186 installed in mounting plate 166, so as to be "forwardly looking" into the interior of the canister housing. Preferably, the electrical lead 176 contains sufficient electrical conductors to control motor 174 to limit the amount of travel in both directions of rotation. Travel of the timing plate 180 in response to energization of valve actuating motor 174 is illustrated, for example, in FIGS. 19–21. It is generally preferred that the sensor 182 be employed to control energization of motor 174 limiting its travel of each direction of rotation.

Timing plate 180 carries a generally L-shaped actuator arm 188 which engages valve operator arm 138, in the manner indicated, for example, in FIG. 27. Referring additionally to FIGS. 19–21, as timing plate 180 is moved in the direction indicated in FIG. 20, the operating arm 138 is moved from its rest or fully closed position illustrated in FIG. 27 in a generally horizontal plane toward the hinged side 124 of mounting plate 142 which it faces. Preferably, the valve operating arm 138 is spring loaded for return to the rest position indicated in FIG. 27. Accordingly, as timing plate 180 is moved in the direction indicated in FIG. 21, actuator arm 188 retreats to the position indicated in FIG. 19, allowing the valve operator arm 138 to return to the fully closed position illustrated in FIG. 27.

With reference to FIG. 19, initially the sensor 192 is covered, indicating to valve actuating motor 174 that rotation should be carried out in the direction indicated in FIG. 20 to prepare valve 136 for an intake of material from the canister to the dispensing pump cylinder. The intake of material corresponds to the sequence of operations shown in FIGS. 28 and 29. When the pump cylinder is filled with the desired amount of material, the valve operator arm 138 is moved an additional mount to prepare for dispensing of the metered material, corresponding to the action indicated in FIG. 30.

Upon completion of a dispensing operation, the timing plate 180 is moved in a direction indicated in FIG. 21, to resume its rest or home input position illustrated in FIG. 19, corresponding to the position illustrated in FIG. 27. In a simple control scheme, the optical sensor 182 can be wired into the motor lead 176 to directly control application of electrical power to motor 174. However, if desired, a conventional motor control circuit or micro computer controller or the like can be employed, if desired. As will be seen herein, the computer control of the metering pump is preferred to achieve a high level of dispense accuracy and accordingly the control of motor 174 is carried out via the computer controller so that proper operating conditions of all major parts of the dispensing apparatus can be monitored and displayed to a user of the equipment.

Referring now to FIGS. 17–30, a pump actuator assembly is generally indicated at 200. Referring briefly to FIG. 27, assembly 200 includes a conventional, bi-directional stepper motor 202 coupled to a threaded shaft 204, and a guide block 206 which is threadingly engaged with shaft 204 so as to travel along shaft 204 in upward and downward directions as indicated in FIGS. 29 and 30. Referring to FIG. 18, motor 202 is secured at the upper end of mounting plate 146. As can be seen, for example, in FIG. 22, upward shaft 208 of motor 202 is coupled to the upper end of threaded shaft 204 by a conventional coupling member 210. Shaft 204 is supported at its upper and lower ends by conventional bearing members 212, 214.

Referring now to FIGS. 24–26, guide block 206 is preferably formed by machining a monolithic block of Delrin plastic or other low friction material. The forward end 216 is milled to form a forwardly opening groove 218 having large funnel-like end portions 200, 222. An aperture 224 is formed in block 206 (see FIG. 26) to receive a bearing race 226. The bearing race 226 has a threaded interior bore 228 for mating with shaft 204. The bearing race is held in place with fasteners 230. As can be seen in FIG. 26, block 206 is machined to form a guide peg 232 which is received in slot 152 of plate 146 (see FIG. 17). Accordingly, as motor 202 is energized to rotate in opposite directions, guide peg 232 travels in slot 152 maintaining a desired alignment, such that the slot 218 opens toward the center of turntable 74. Thus, as turntable 74 is rotated, a plurality of canister assemblies and their associated washers 134 pass through guide block 206, in the manner indicated in FIG. 27.

When a desired canister assembly approaches dispensing station 240 (see FIG. 9) located immediately in front of pump actuator assembly 200, rotation of the turntable is slowed in preparation for positioning the washer 134 of the selected canister assembly in guide block 206. In a preferred embodiment, the control components of the dispensing assembly are coupled to a micro-computer 244 located in the cabinet base 14, as indicated in FIG. 8. For example, as indicated in FIG. 14, control wiring 246 for drive motor 94 is routed to controller 244 to control selection of operation between the turntable and stirring elements, and when turntable operation is selected, to control rotation and angular position of the turntable. Accordingly, controller 244 is able to sense when a desired canister assembly is approaching the dispense station 240.

Figure 11:
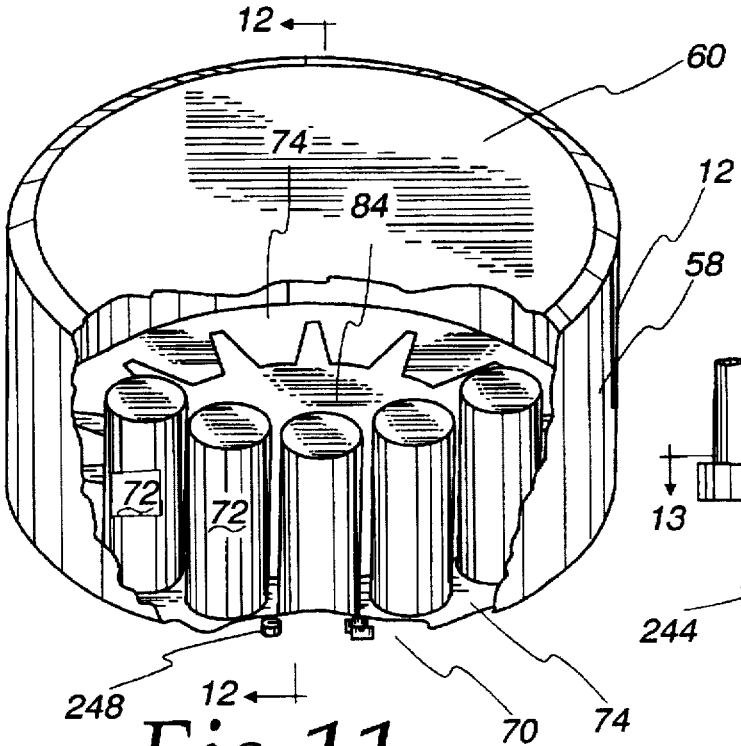
FIG. 11 is a fragmentary perspective view thereof, shown partly broken away to illustrate the dispensing canisters.
Figure 12:
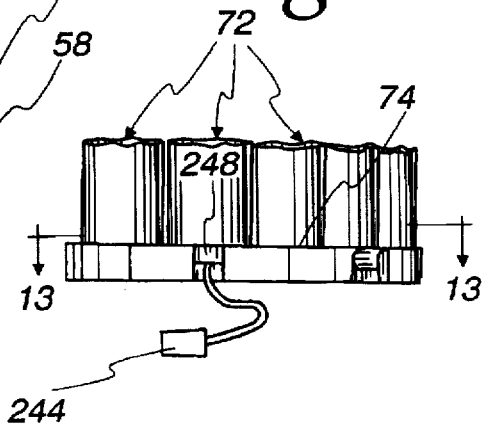
FIG. 12 is a fragmentary elevational view of the turntable portion thereof.

In the preferred embodiment, the turntable is constructed of lightweight materials. Nonetheless, there is a considerable mass carried by the turntable, represented, in part, by the various canister assemblies, including their associated dispense pumps and valves in addition to materials loaded in the canisters. In order to insure precise stopping of the turntable, at least one electromagnet 248 is mounted on bottom wall 70 (see FIGS. 11 and 12) so as to be positioned immediately adjacent the bottom surface of turntable 74. Under command of controller 244, magnet 248 is energized, effectively stopping further rotation of turntable 74, thus bringing the desired canister assembly to rest at dispensing station 240. The electromagnet is preferably located adjacent the dispense station so that it can be energized during pump operation to prevent the turntable from being pulled up and also from being pushed down. If desired, the controller 244 can be operated to reduce rotational speed of the turntable before the electromagnet is energized. Further, the current applied to the electro-magnet can be increased either step-wise or in a smoothly curve fashion during a braking action. For example, a preliminary, reduced braking force can be applied before final stages of a braking action.

As indicated in FIG. 19, dispense pump actuator motor 202 is connected through cable 250 to controller 244. As also indicated in FIG. 19, the dispense valve actuator motor 174 and the aforementioned sensors are also coupled to controller 244. Accordingly, as mentioned, controller 244 is able to direct turntable drive motor 94 and electromagnet 248 to position the canister assembly at the dispense station, as mentioned. Further, controller 244 initiates a sequence of events for carrying out a dispensing operation. As mentioned, washer 134 is brought into engagement with guide block 206. Under command of controller 244, motor 200 is energized to raise guide block 206 in the manner indicated in FIGS. 28 and 29 so as to withdraw a preselected amount of material from the canister into the pump chamber. Thereafter, valve motor 174 is energized so as to rotate arm 188, moving the dispense valve arm 138 to an open position. This corresponds to displacement of arm 188 from the position shown in FIG. 19 to the position shown in FIG. 21. Accordingly, with the dispense valve in an open position, motor 200 is then energized for rotation in an opposite direction, lowering guide block 206 as indicated in FIG. 30, to dispense the contents of the pump chamber, thus completing dispensing of the chosen ingredient. The dispense cycle is repeated for the number of ingredients required until the dispensing operation is complete.

As will now be appreciated, the service door carries sensitive equipment which can be adversely affected by contamination, such as that associated with filling and cleaning the storage canisters. In such instances, the service door can be easily swung out of the way to remove its equipment from the contamination site. Further, with the service door withdrawn, a fairly large opening is provided for carrying out cleaning and other maintenance operations in the turntable area. Further, with the sensitive equipment mounted on a service door, the door can be removed for offsite maintenance, adjustments and calibration. Also, the service door and its components can be built and tested on a bench, in the first instance.

The drawings and the foregoing descriptions are not intended to represent the only forms of the invention in regard to the details of its construction and manner of operation. Changes in form and in the proportion of parts, as well as the substitution of equivalents, are contemplated as circumstances may suggest or render expedient; and although specific terms have been employed, they are intended in a generic and descriptive sense only and not for the purposes of limitation, the scope of the invention being delineated by the following claims.

What is claimed is:

1. Dispensing apparatus for dispensing a plurality of pulverulent materials, comprising:

a plurality of canisters for storing materials to be dispensed;

a dispensing station whereat the materials are dispensed;

a plurality of metering pumps, associated with respective ones of said plurality of canisters for receiving materials therefrom, the metering pumps including pump operators for dispensing preselected amount of materials withdrawn from the canisters;

a movable platform for supporting the plurality of canisters and for presenting preselected ones of the plurality of canisters to the dispensing station;

a frame supporting the platform;

a door at the dispensing station, hingedly supported by the frame;

pump actuator means carried on the door, for engaging the pump operators and for actuating the pump operators to selectively withdraw and dispense preselected amounts of materials from the canisters.

2. The apparatus of claim 1 further comprising a plurality of valves associated with respective ones of said plurality of canisters for controlling the flow of materials therefrom, the valves including valve operators for moving the valves between closed and open positions.

3. The apparatus of claim 1 further comprising valve actuator means carried on the door, for engaging the valve operators to selectively move the valves between closed and open positions.

4. The apparatus of claim 1 wherein the valve actuator means comprises a timing disk rotatably mounted on the door, and a timing arm carried on the timing disk to engage and rotate the valve operators to selectively move the valves between closed and open positions.

5. The apparatus of claim 1 wherein the valve actuator means further comprises sensor means carried on the door for sensing the position of the timing disk and for sending a position signal in response thereto.

6. The apparatus of claim 5 wherein the valve actuator means further comprises a motor carried on the door and drivingly engaging the timing disk, the motor responsive to the position signal to control movement of the timing disk.

7. The apparatus of claim 1 wherein the door lies in a plane and the motor is mounted to a mounting plate extending at an acute angle to the plane.

8. The apparatus of claim 1 wherein the a movable platform contains material attracted by a magnet, the apparatus further comprising magnet means mounted on the frame, adjacent the platform, the magnet means selectively operable to selectively attract the platform to impede movement of the platform so as to guide the presentation of preselected ones of the plurality of canisters to the dispensing station.

9. The apparatus of claim 8 wherein the magnet means is located adjacent the dispensing station and when operated, engages the platform to support the platform against dislocation forces caused by the pump actuator means as the pump operators are actuated to selectively withdraw and dispense preselected amounts of materials from the canisters.

10. The apparatus of claim 9 wherein the platform is mounted for rotation about an axis, the pump operator comprises a pump piston shaft extending generally parallel to the axis and carries an outwardly extending protrusion, the pump actuator means comprises a guide block defining a groove for receiving the protrusion and means for moving the guide block generally parallel to the direction of the axis.

11. The apparatus of claim 10 wherein the platform comprises a turntable in a generally horizontal plane, the magnet means is located below the turntable and when operated applies a force to the turntable in a generally downward direction, and the piston shaft is moved in a generally upward direction during operation of the metering pump.

12. The apparatus of claim 1 wherein at least one of the plurality of canisters includes a stirring blade mounted on a stirring rod and the apparatus further includes a stir drive plate carried on the platform, the stirring rod engaging the stir drive plate.

13. The apparatus of claim 12 wherein the stir drive plate comprises a plurality of outwardly projecting fingers, the fingers defining apertures for receiving respective ones of a plurality of the stirring rods.

14. The apparatus of claim 13 wherein the stir drive plate comprises a centrally located hole and the apparatus further comprises a stir drive arm received in the centrally located hole and means for eccentrically rotating the stir drive arm.

15. The apparatus of claim 12 wherein the stir drive plate comprises a plurality of outwardly projecting fingers carrying upwardly directed pins for engaging the stirring rods.

16. The apparatus of claim 15 wherein the stir drive plate defines a pair of holes and the apparatus further comprises a pair of stir drive arms received in respective ones of the holes and means for eccentrically rotating the stir drive arms.

17. The apparatus of claim 16 wherein the means for eccentrically rotating the stir drive arms rotates the stir drive arms in synchronism.

18. The apparatus of claim 17 wherein the means for eccentrically rotating the stir drive arms includes a timing belt engaging both stir drive arms, the means for eccentrically rotating the stir drive arms including means for driving the timing belt.

19. Apparatus for dispensing flowable materials, comprising:

a plurality of canisters for holding the flowable materials, a plurality of metering pumps for withdrawing preselected quantities of materials from the canisters and for discharging the materials, and a plurality of valves associated with the metering pumps, for controlling the flow of materials discharged from the metering pumps;

a workstation adjacent the canisters where materials are dispensed;

a housing at least partly surrounding the canisters;

turntable means for carrying the metering pumps and valves so as to present a preselected canister to the workstation, at least a portion of the turntable being made of magnetic material;

drive means for moving the turntable to bring a selected canister to the workstation; and braking means adjacent the turntable to stop movement of the turntable to align the selected canister at the workstation, the braking means comprising an electromagnet supported by the housing adjacent the turntable to magnetically attract the turntable so as to engage the turntable.

20. The apparatus of claim 19 wherein the electromagnet is located immediately beneath the turntable to support the turntable against vertically directed forces applied to the turntable is engaged by the electromagnet.

21. The apparatus of claim 19 wherein the metering pumps include a piston having a vertical component of movement during a pumping operation, and the electromagnet is located adjacent the workstation and the turntable to support the turntable against upward movement associated with operation of the metering pumps.

22. The apparatus of claim 19 wherein the braking means comprises a plurality of electromagnets located immediately beneath the turntable.

23. Apparatus for dispensing flowable materials, comprising:

a plurality of canisters for holding the flowable materials, a plurality of metering pumps associated with the canisters for withdrawing preselected quantities of materials from the canisters and for discharging the materials, and a plurality of valves associated with the metering pumps, for controlling the flow of materials discharged from the metering pumps;

a workstation adjacent the metering pumps and valves, where materials are dispensed;

turntable means for moving the canisters so as to present a preselected metering pump and valve to the workstation;

drive means for moving the turntable to bring a selected canister to the workstation;

a first housing at least partly surrounding the metering pumps and valves and defining a doorway opening, a second housing defining an enclosed cavity and supporting the first housing from below containing the drive means;

a door frame joined to the first housing so as to surround the doorway opening, the door frame extending above the first housing;

a service door hingedly mounted to the door frame so as to swing between closed and open positions, toward and away from the canisters;

a metering pump actuator carried on the service door, including pump engaging means for operating the pump to withdraw material from the canisters to dispense the withdrawn material; and a valve actuator carried on the service door, including valve engaging means for moving the valve between open and closed positions to control flow of material from the pump.

24. The apparatus of claim 23 wherein the second housing comprises a plurality of wall assemblies, the wall assemblies comprising an internal wall frame having an open central portion, and an outer panel releasably attached to the wall frame.

25. The apparatus of claim 23 wherein the outer panel is secured to the wall frame with hook and loop fastener material.

26. Apparatus for dispensing flowable materials, comprising:

a plurality of canisters for holding the flowable materials;

a plurality of metering pumps for withdrawing preselected quantities of materials from the canisters and for discharging the materials;

a plurality of valves associated with the metering pumps, for controlling the flow of materials discharged from the metering pumps, the valves including rotating valve operators for moving the valves between closed and open positions;

a workstation including workstation framework adjacent the canisters where materials are dispensed;

valve actuator means at the workstation, for engaging the valve operators to selectively move the valves between closed and open positions, the valve actuator means including a timing disk mounted on the workstation framework for rotational movement, and a timing arm carried on the timing disk to engage the valve operators to selectively move the valves between closed and open positions.

27. The apparatus of claim 26 wherein the valve actuator means further comprises sensor means carried on the workstation framework for sensing the position of the timing disk and for sending a position signal in response thereto.

28. The apparatus of claim 27 wherein the valve actuator means further comprises a motor carried on the workstation framework and drivingly engaging the timing disk, the motor responsive to the position signal to control movement of the timing disk.

29. The apparatus of claim 26 wherein the valve operators are mounted for movement in a generally horizontal plane and the timing disk is mounted in a substantially vertical plane, and is positioned with respect to valve operators so as to cause the valve operators to move in the generally horizontal plane to move the valves between closed and open positions.

* * * * *